United States Patent [19]

Noda

[11] Patent Number: 4,975,739

[45] Date of Patent: Dec. 4, 1990

[54] ELECTROMAGNETIC RELAY

[75] Inventor: Syoso Noda, Chiryu, Japan

[73] Assignee: Nippondenso Co., Ltd., Kariya, Japan

[21] Appl. No.: 422,800

[22] Filed: Oct. 18, 1989

[30] Foreign Application Priority Data

Oct. 21, 1988 [JP] Japan ..... 63-266710

[51] Int. Cl.[5] ..... H01H 51/08; H01F 15/10

[52] U.S. Cl. ..... 335/128; 335/202; 336/192

[58] Field of Search ..... 335/128, 135, 202; 336/192

[56] References Cited

U.S. PATENT DOCUMENTS 4,149,131 4/1979 Kawamura et al. ..... 335/202

FOREIGN PATENT DOCUMENTS 55-111142 8/1980 Japan .

*Primary Examiner*—H. Broome

*Attorney, Agent, or Firm*—Cushman, Darby & Cushman

[57] ABSTRACT

Disclosed is an electromagnetic relay. A bobbin on which a coil is wound has a plurality of projections on which end portions of the coil lead left unwound on either side thereof where the coil-winding starts and ends are wound in such a manner as to bridge the projections. The end portions of the coil lead, each bridging the associated projections, are connected to connection terminals through which they are connected in turn to an external circuit. Because the end portions of the coil lead have their position relative to the connection terminals for external connection determined easily and accurately, the process of connecting these members can be automatized without difficulty.

3 Claims, 3 Drawing Sheets

ELECTROMAGNETIC RELAY

BACKGROUND OF THE INVENTION

The present invention relates to an electromagnetic relay characterized by the manner in which a coil lead for the electromagnet is connected to terminals through which the coil lead is connected in turn to, e.g., an external circuit.

A conventional electromagnetic relay has an arrangement such as that shown in Japanese Utility Model Unexamined Publication No. 55-111142, in which the coil lead is connected to terminal portions of the base by winding the end portions of the coil lead around the terminal portions, thereby connecting and fixing the coil lead to the terminal portions. Another method of connecting these members is shown in FIG. 3, in which junction terminals fixed to the coil bobbin are employed. During the winding process, the coil lead is connected to the junction terminals, and, after the entire coil section has been fixed to the base supporting terminals for establishing external connection, the junction terminals and the external-connection terminals are connected for electrical connection by, e.g., a welding method. Specifically, referring to FIG. 3, the device includes a terminal 1 through which a coil lead is connected to an external circuit, a junction terminal 2*a* for the coil lead, a coil 11 for the electromagnet, a connecting portion 2*b* of the coil lead, a coil bobbin 7, stationary terminals 15 and 16, a yoke 8, a core (iron core) 14, a plate 17, a spring 18*a*, a base 12, and a casing 13. The coil lead junction terminal 2*a* is fixed to the coil bobbin 7, and, during a winding process, the connecting portion 2*b* of the coil lead is wound around the junction terminal 2*a*, as shown in the figure, and is then connected thereto by means of solder or the like. Thereafter, when the yoke 8 to which the coil bobbin 7 and the core 14 are fixed has been assembled on the base 12, the junction terminal 2*a* is connected to the coil lead connecting terminal 1 for external connection by, e.g., a welding method.

However, the above-described connecting methods involve the following problems. With the first method, the position of the end portions of the coil lead is not fixed, this renders the connection of the coil lead to the terminal portions of the base difficult, thereby making it very difficult to automatize the operation of connecting the end portions of the coil lead. With the second method, although each of the above-described connecting processes can be automatized relatively easily, the method requires junction terminals for the connection of the coil lead, and this leads to an increase in the number of the required component parts, hence, to an increase in production cost as well as in the number of the required connecting processes.

SUMMARY OF THE INVENTION

It is an object of the present invention to provide an electromagnetic relay which facilitates the automatization of the process of connecting the end portions of the coil lead to the terminals for, e.g., external connection, and which allows this connection to be performed without requiring the conventionally used junction terminals.

To this end, according to the present invention, there is provided an electromagnetic relay having a stationary contact, a movable contact, and a coil forming an electromagnet capable of being excited to drive the movable contact, the electromagnetic relay thus being capable of opening and closing an electric circuit including the stationary contact and the movable contact, comprising: a coil bobbin on which the coil is wound with end portions of the coil lead left unwound on either size thereof where the coil-winding starts and ends, and which has a plurality of projections on which the end portions of the coil lead are wound in such a manner as to bridge the projections; coil lead connecting terminals to which the bridging end portions of the coil lead are connected, and which is capable of exciting the coil; a yoke supporting the coil bobbin and capable of forming a magnetic path; and a base to which the coil lead connecting terminals and the yoke are fixed.

By virtue of the above-described arrangement, the end portions of the coil lead left unwound on either side thereof where the coil-winding starts and ends are disposed in such a manner as to bridge the projections. Accordingly, when the yoke supporting the coil bobbin is fixed to a predetermined position of the base, it is possible to easily and accurately determine the position of the end portions of the coil lead relative to the connection terminals fixed to the base. As a result, the automatization of the assembly of these members can be easily achieved.

The above and other objects, construction, operation and effect of the present invention will become more apparent from the following description of embodiments, taken in connection with the accompanying drawings.

DESCRIPTION OF THE PREFERRED EMBODIMENTS

Figure 1A:
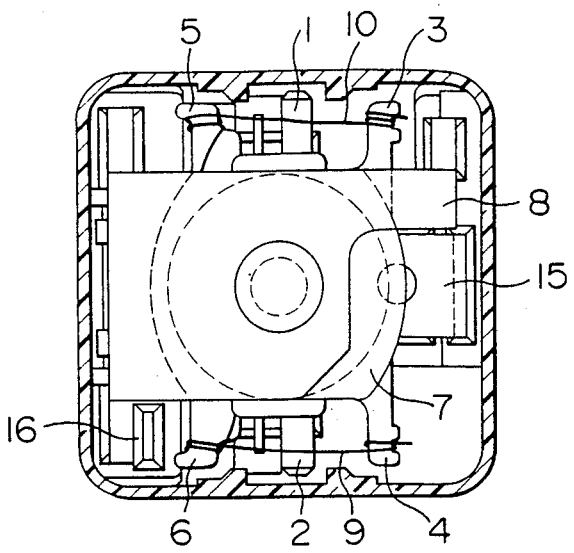
FIGS. 1A and 1B are partially sectioned plan and side views, respectively, showing the internal structure of an electromagnetic relay in accordance with one embodiment of the present invention.
Figure 1B:
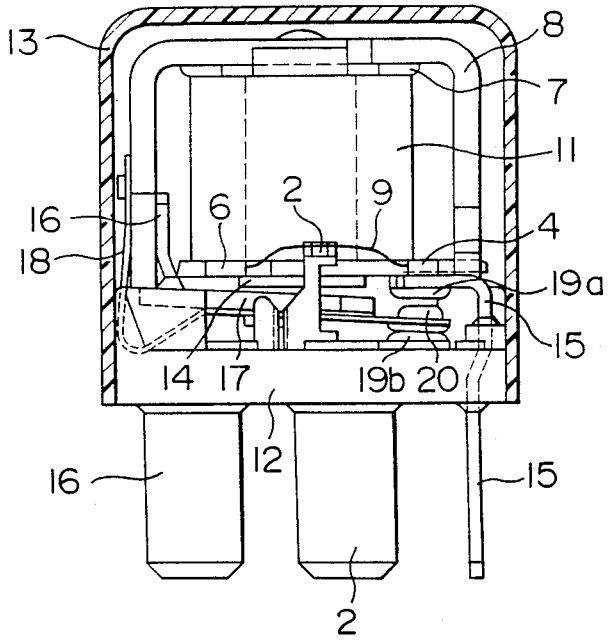

Referring to FIGS. 1A and 1B, an electromagnetic relay in accordance with one embodiment of the present invention includes terminals 1 and 2 to which a coil lead of the relay is connected and which also allows the connection therewith of an external connector. A coil bobbin 7 of the relay is formed of a resin material and has a plurality of projections 3, 4, 5 and 6 on which end portions 9 and 10 of the coil lead are wound. The coil bobbin 7 and a core (iron core) 14 are fixed to a yoke 8. A coil 11 forms the electromagnet of the relay. The coil lead connecting terminals 1 and 2 are fixed to a base 12 formed of a resin material. A casing 13 is formed of a resin material. A stationary contact 19*a* is fixed to one end of a first stationary terminal 15 capable of electrically connecting with the stationary contact 19*a*, while a movable contact 20 is carried by one end of a spring 18 which is in the form of a metal plate and through which a second stationary terminal 16 is capable of electrically connecting with the movable contact 20. The second stationary terminal 16 extends outwardly from an intermediate position between holes 27 and 28 (described later) formed in the base 12. An armature plate 17 is fixed to the spring 18 and is capable of being attracted by the core 14. A stopper 19*b* is provided in opposition to the stationary contact 19*a*.

Figure 2:
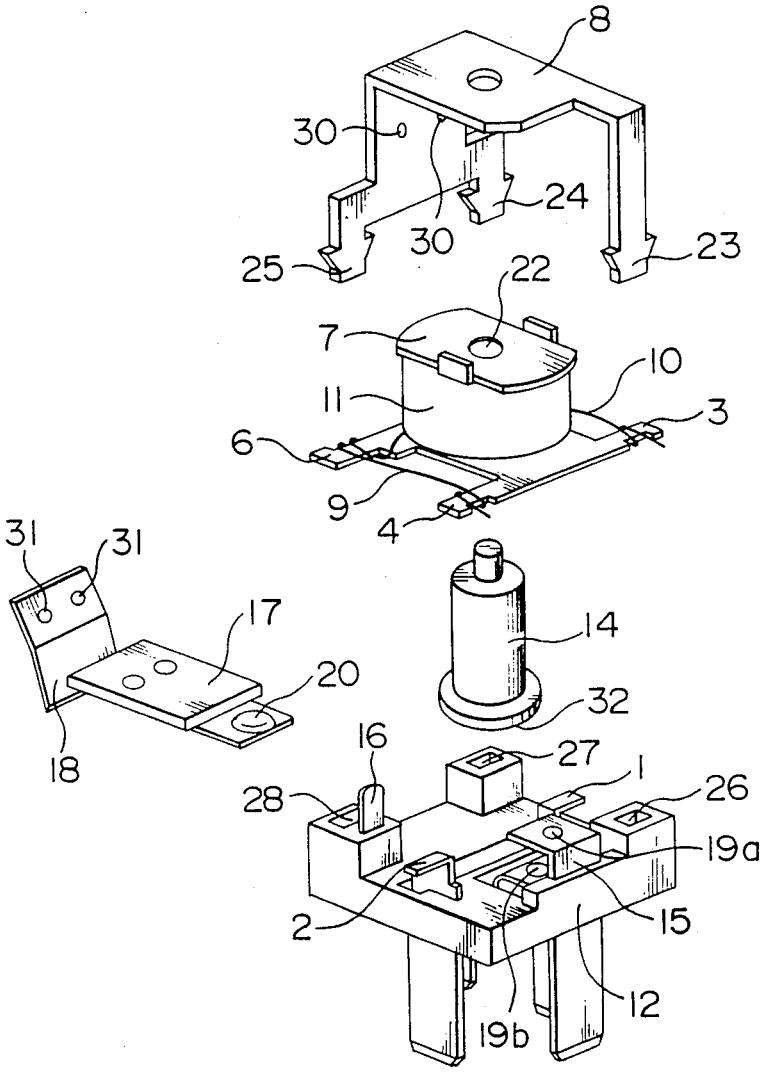
FIG. 2 is an exploded perspective view of the electromagnetic relay, shown in FIGS. 1A and 1B.
Figure 3:
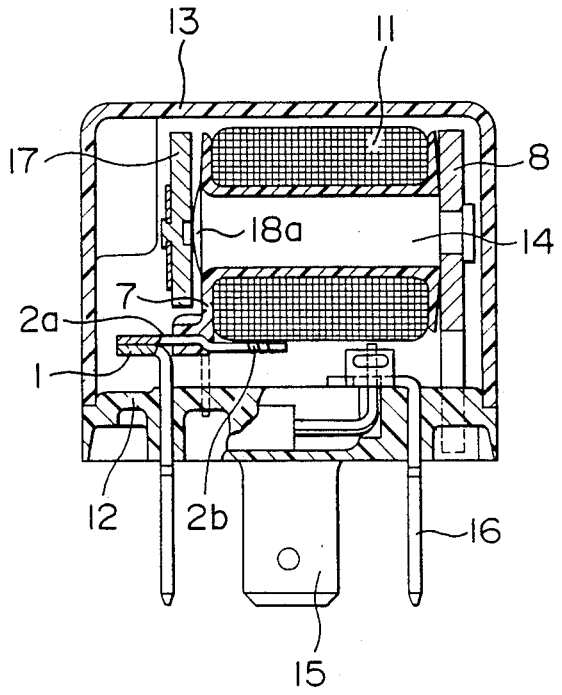
FIG. 3 PRIOR ART
FIG. 3 is a sectional view showing the structure of a conventional electromagnetic relay.

FIG. 2 is an exploded perspective view of the electromagnetic relay. The coil lead connecting terminals 1 and 2, as well as the stationary terminals 15 and 16 are fixed to the base 12. The stationary contact 19*a* is fixed to the stationary terminal 15 by holding it in place by caulking or welding it. The coil lead connecting terminals 1 and 2 have their free end portions bent into an L-shape, as shown in the figure, thereby facilitating their contact with the coil lead end portions 10 and 9, respectively. The coil 11 is wound on the coil bobbin 7, with the end portions 9 and 10 of the coil lead left unwound. The projections 3 to 6 formed on the coil bobbin 7 are positioned on those sides of the coil bobbin 7 which correspond to the side where the coil-winding starts and ends. The end portions 9 and 10 of the coil lead are wound on and are thus fixed to the projections 3 to 6. Specifically, as shown in the figure, each of the end portions 10 and 9 on the coil-winding start or end side is wound on two projections (3 and 5, or 4 and 6) in such a manner as to bridge them, so that the relative position of the coil lead connecting terminals 1 and 2, and the coil lead end portions 10 and 9 will be determined.

After the core 14 having a head 32 has been inserted through an internal through hole 22 of the coil bobbin 7, the coil bobbin 7 with the core 14 is assembled on the yoke 8 to be fixed thereto. On the other hand, the armature section is formed by assembling the armature plate 17 as well as the movable contact 20 on the spring 18, as shown in the figure. The yoke 8 with the coil bobbin 7 is fixed to the base 12 by having their projections 23 to 25 force fitted into holes 26 to 28 of the base 12, respectively. The arrangement of the device is such that, at the time of this fixing, parts of the bridging coil lead end portions 10 and 9, each bridging the associated projections, are positioned upon the bent portions of the coil lead connecting terminals 1 and 2. Subsequently, these parts of the coil lead end portions 10 and 9, and the coil lead connecting terminals 1 and 2 are joined together by a welding or soldering method. Thereafter, the armature section is inserted into the gap between the yoke 8 and the base 12 from a side portion thereof, and it is then assembled on the yoke 8 with holes 31 formed in the spring 18 being aligned with holes 30 formed in the yoke 8. The inwardly extending end portion of the stationary terminal 16 is welded to a portion of the yoke 8 and is thus joined thereto.

Next, the operation of the electromagnetic relay having the above-described construction will be described. When a certain input voltage is applied across the coil lead connecting terminals 1 and 2, the coil 11 is excited, and a magnetic circuit is formed by the yoke 8, the core 14, and the armature plate 17, whereby a certain attracting force acts on the plate 17 which is in turn attracted by the core head 32. As a result, the movable contact 20 comes into contact with the stationary contact 19*a*, thereby forming a loaded current circuit between the stationary terminals 15 and 16.

As has been described above, according to the present invention, the end portions of the coil lead, each in its bridging state, are connected to the terminals through which the end portions are connected in turn to an external circuit. This arrangement is advantageous in that the process of connecting the coil lead end portions and the coil lead connecting terminals can be automatized with ease, and without using junction terminals conventionally provided as junctions between these members.

What is claimed is:

1. An electromagnetic relay having a stationary contact, a movable contact, and a coil forming an electromagnet capable of being excited to drive said movable contact, said electromagnetic relay thus being capable of opening and closing an electric circuit including said stationary contact and said movable contact, comprising:

a coil bobbin on which said coil is wound with end portions of a coil lead left unwound on either side thereof where the coil-winding starts and ends, and which has a plurality of projections on which said end portions of said coil lead are wound in such a manner as to bridge said projections;

coil lead connecting terminals to which said bridging end portions of said coil lead are connected, and which is capable of exciting said coil;

a yoke supporting said coil bobbin and capable of forming a magnetic path; and a base to which said coil lead connecting terminals and said yoke are fixed.

2. An electromagnetic relay according to claim 1, wherein said base to which said coil lead connecting terminals are fixed has holes at predetermined positions thereof which holes are capable of receiving portions of said yoke supporting said coil bobbin, said end portions of said coil lead being brought into contact with said coil lead connecting terminals by inserting said portions of said yoke into said holes of said base, thus fixing said yoke to said base.

3. An electromagnetic relay according to claim 1 or 2, further comprising a plate spring cantilevered from said yoke, carrying thereon an armature plate and fitting at a free end thereof said movable contact.

* * * * *